US011806559B2

(12) United States Patent
Auston et al.

(10) Patent No.: US 11,806,559 B2
(45) Date of Patent: Nov. 7, 2023

(54) COUPLER FOR A FALL PROTECTION DEVICE

(71) Applicant: CHECKMATE LIFTING & SAFETY LTD, Kent (GB)

(72) Inventors: Oliver Auston, Faversham (GB); Christopher Stockbridge, Sittingbourne (GB)

(73) Assignee: CHECKMATE LIFTING & SAFETY LTD, Kent (GB)

( * ) Notice: Subject to any disclaimer, the term of this patent is extended or adjusted under 35 U.S.C. 154(b) by 473 days.

(21) Appl. No.: 16/744,544

(22) Filed: Jan. 16, 2020

(65) Prior Publication Data

US 2020/0230445 A1 Jul. 23, 2020

Related U.S. Application Data

(60) Provisional application No. 62/886,064, filed on Aug. 13, 2019.

(30) Foreign Application Priority Data

Jan. 22, 2019 (GB) ..... 1900892

(51) Int. Cl.
*A62B 35/00* (2006.01)

(52) U.S. Cl.
CPC ..... *A62B 35/0037* (2013.01); *A62B 35/0018* (2013.01)

(58) Field of Classification Search
CPC ..... A62B 35/0037; A62B 35/0025; A62B 35/0031; A62B 35/0018; A62B 35/0093; A62B 35/0006
See application file for complete search history.

(56) References Cited

U.S. PATENT DOCUMENTS

D209,013 S 10/1967 McElroy
D309,255 S 7/1990 Karow, Jr.
D479,798 S 9/2003 Wall
(Continued)

FOREIGN PATENT DOCUMENTS

WO 2016200809 A1 12/2016

OTHER PUBLICATIONS

International Search Report from PCT/GB2020/050128; Claire Masterson-Zwinkels; dated May 4, 2020; 5 pages.
(Continued)

*Primary Examiner* — Alissa L Hoey
(74) *Attorney, Agent, or Firm* — Dicke, Billig & Czaja, PLLC

(57) ABSTRACT

A coupler to couple a D-ring from a harness to a fall arrest device connector provides walls to guide and contain the harness webbing whilst allowing it to move freely (reducing webbing wear) and does not necessitate the removal of the coupler, connector, or D-ring as may be required for harness size adjustment. The coupler has a circular passageway which runs through the length allowing a shaft of the connector to couple to the part whilst maintaining 180 degrees of swivel. The coupler also has a groove which runs along the length to fit onto a central bar of the harness D-ring. The design is such that, during a fall, should the device break, the webbing will remain securely coupled to the D-ring of the harness.

25 Claims, 11 Drawing Sheets

(56) References Cited

U.S. PATENT DOCUMENTS

| | | | | |
|---|---|---|---|---|
| D479,983 | S | 9/2003 | Wall | |
| 7,073,627 | B2 * | 7/2006 | Casebolt | A62B 35/0031 119/770 |
| 7,178,632 | B2 | 2/2007 | Casebolt et al. | |
| D560,482 | S | 1/2008 | Casteel et al. | |
| D576,025 | S | 9/2008 | Mazzocco | |
| D583,655 | S | 12/2008 | Mazzocco | |
| D621,253 | S | 8/2010 | Heindl | |
| D663,494 | S | 7/2012 | Milliff et al. | |
| 8,276,712 | B2 | 10/2012 | Smith et al. | |
| 8,938,864 | B2 | 1/2015 | Casebolt | |
| 9,174,073 | B2 | 11/2015 | Casebolt et al. | |
| 9,273,717 | B2 * | 3/2016 | Schlangen | A62B 35/0037 |
| 9,427,608 | B2 | 8/2016 | Fink et al. | |
| 9,993,048 | B2 | 6/2018 | Casebolt | |
| 10,065,057 | B1 | 9/2018 | Hung | |
| 10,137,322 | B2 * | 11/2018 | Perner | A62B 35/0025 |
| D836,185 | S | 12/2018 | Lippka | |
| 10,232,199 | B2 | 3/2019 | Perner et al. | |
| 10,300,315 | B2 | 5/2019 | Yang et al. | |
| 10,343,001 | B2 * | 7/2019 | Seman | A62B 35/0075 |
| 10,420,967 | B2 * | 9/2019 | Poldmaa | A62B 35/0056 |
| 10,625,105 | B2 * | 4/2020 | Hetrich | A62B 35/0031 |
| D899,241 | S | 10/2020 | Gridley | |
| 10,799,732 | B2 * | 10/2020 | Bouquier | A62B 35/0006 |
| D901,285 | S | 11/2020 | Nguyen | |
| 10,954,992 | B2 * | 3/2021 | Jones | A63B 29/02 |
| 11,369,816 | B2 * | 6/2022 | Carrasca | A62B 35/0037 |
| 2005/0067222 | A1 | 3/2005 | Casebolt et al. | |
| 2016/0361577 | A1 | 12/2016 | Perner et al. | |
| 2017/0056692 | A1 * | 3/2017 | Cowell | A62B 35/0006 |
| 2017/0120087 | A1 * | 5/2017 | Cowell | A62B 35/0006 |
| 2017/0291046 | A1 | 10/2017 | Bouquier | |
| 2019/0001165 | A1 | 1/2019 | Schurian et al. | |
| 2020/0155879 | A1 | 5/2020 | Chang | |
| 2020/0206549 | A1 * | 7/2020 | Shaver | A62B 35/0037 |
| 2020/0230445 | A1 | 7/2020 | Auston | |
| 2021/0046339 | A1 * | 2/2021 | Canfield | A62B 35/0037 |
| 2021/0178202 | A1 * | 6/2021 | Carroccia | A62B 35/0018 |
| 2021/0353982 | A1 | 11/2021 | Hung et al. | |
| 2022/0080233 | A1 * | 3/2022 | Safe | A62B 35/0037 |
| 2022/0134150 | A1 * | 5/2022 | Auston | F16B 13/00 182/3 |
| 2022/0233897 | A1 * | 7/2022 | Hung | A62B 35/0037 |
| 2023/0026773 | A1 * | 1/2023 | Wang | A62B 35/0018 |

OTHER PUBLICATIONS

Walmart, "Reese Towpower 0.33 lb. capacity Coupler Lock", first available Aug. 12, 2014 (https://www.walmart.com/ip/Reese-Towpower-0-33-lb-capacity-Coupler-Lock/24087300?athcpid=24087300) (Year: 2014).

Amazon, "CZC Auto Black Trailer Hitch Coupler Lock", first available Jul. 18, 2019. (https://www.amazon.com/CZC-AUTO-Black-Trailer-Coupler/dp/B07VGX5494) (Year: 2019).

Zips, "STECK Tie Rod Coupler", first accessed May 14, 2021. (https://zips.com/parts-details/steck-tie-rod-coupler-trc1) (Year: 2021).

AJK Offroad, "Weld on D-Ring Shackle", first available Jan. 8, 2021 (https://ajkoffroad.com/shop/weld-on-d-ring-shackle-clevis-tab-mount/) (Year: 2021).

* cited by examiner

COUPLER FOR A FALL PROTECTION DEVICE

BACKGROUND

When working at heights, a person is generally attached to a safety line or rope in order to provide a safety mechanism to restrict a fall. The safety line is fixed at one end to an anchor point and at the other end to the person. Such safety mechanisms generally also incorporate a device for gradually arresting the fall rather than to rely on a simple rope or line which would prevent any fall with a sharp, sudden halt. A sharp, sudden halt of a fall would produce excessive forces which in themselves may also cause or increase any potential injuries to the user.

These safety mechanisms may be attached to a harness or garment being worn by the user. In particular, the safety line is attached to an anchor point and the other end of the safety line is attached to a simple portable safety mechanism device which is then attached to a person through a harness/garment. Alternatively, a robust static safety mechanism including a braking system may be provided adjacent to the anchor point.

Some safety mechanisms include energy absorbers, such as sections of webbing or bungee to provide a gradual absorption and distribution of the falling forces. For example, the safety device may include a section of webbing with a stitching system whereby the stitching is arranged to tear as the person falls whilst the webbing still remains connected to a part of the harness to eventually stop the fall at an end of the stitching section. This tearing of the stitching system gradually reduces the falling forces. The length of the stitching section defines the force absorbing distance and the system of the stitching can be adjusted for use in absorbing different levels of forces.

Alternative safety systems comprise a lanyard incorporating a length of bungee (stretchable material). Again, if a person falls, the material will stretch and the falling forces will be absorbed and distributed over a distance as the material stretches. It is recognized that other types of energy absorbers could be used.

Other portable fall arrest devices comprises braking systems located within a housing with an attachment member to enable the fall arrest device to be attached to a harness of a garment being worn by a user. The portable fall protection device is compact and lightweight in order for the device to be mounted on a rear of a user and carried without hindrance to the user. This enables the user to continue to undertake tasks at height. Such portable fall arrest devices or portable fall restraint devices may include lanyards with stretchable materials or elongating members to absorb energy should a fall occur.

Self-retracting lifelines or lanyards (SRLs) are frequently used and these are designed to reduce the distance of and/or stop a fall by having a braking mechanism as mentioned above. SRLs or lanyards may also absorb some of the energy of a fall.

A safety harness is used in conjunction with these fall protection devices. The safety harness may be a full body safety harness which provides a D-ring for attachment to the lifeline/fall protection device. Such harnesses generally provide shoulder straps and leg straps. The shoulder straps typically extend down the back of a user and cross over each other at an intersection. The D-ring is typically provided at this intersection to help secure and dissipate forces from the lifeline. The D-ring may be associated with a D-ring pad which guides and secures the webbing sections forming the straps.

In some situations, users may be required to move from a first location to a second location during which the user may have to detach a lifeline from the support structure. Accordingly, this would provide a time period during which the user would not be protected from a fall. To address such situations, the user may be attached to two separate lifelines such that the first lifeline can be detached to leave the second lifeline protecting the user. The first lifeline is then attached to the second supporting structure. Finally, the second lifeline can then be detached for the first supporting structure and reattached to the second supporting structure. Accordingly this use of two (dual or double or twin) fall protection devices maintains the fall protection for this user even during transition and movement to a different separate location with a new supporting structure.

In such systems, both fall protection devices have an associated fastener. These fasteners may comprise swivel eyes which are separately secured to a connector which may be a carabiner or similar type connector. The swivel eyes help to enable the user to move freely without being restrained by the fall protection devices. The carabiner may then be attached through the webbing straps extending from the D-ring pad in order to capture the webbing straps and secure the two portable fall protection devices to the harness. As the user moves around, the connector will inevitably move relative to the webbings straps. This relative movement enables the user to freely move without significant restraint. Such restricted relative movement may cause abrasion and wear/tear to the straps such that these may need to be monitored and inspected to ensure that the fall protection is still sufficient and no significant weakness has been introduced.

In the present description, the term fall protection device is defined to include both fall restraint device and fall arrest device and similar apparatus such as rescue device.

It is an aim of the present invention to overcome at least one problem associated with the prior art, whether referred to herein or otherwise.

SUMMARY

According to a first aspect of the present invention there is provided a coupler for a fall protection device, the coupler comprising a body having:

- a distal end and a proximal end;
  - the distal end comprising a webbing guidance surface over which webbing is extendable; and
  - the proximal end comprising an engagement portion to engage a D-ring of a harness,
- the body further comprising a securement passageway through which a shaft of a connector of a fall protection device is securable, the securement passageway comprising a bearing surface which acts with an outer surface of the shaft of the connector to enable the shaft of the connector to rotate within the securement passageway and for the connector to articulate relative to the coupler.

Preferably the connector and the coupler provide an articulating connection (joint) of the fall protection device to the harness.

Preferably the coupler comprises a single piece component. Preferably the shape of the body is moulded to provide all individual elements of the coupler. Preferably the body is absent of any moving components.

Preferably the body comprises a moulded body.

The fall protection device (or system) may comprise a first fall protection device and a second fall protection device. Each fall protection device may provide an independent lifeline. Each fall protection device may comprise independent harness attachment means to attach the portable fall protection device to a harness and for the portable fall protection device to be carried by a user, a lifeline and a braking system.

Preferably the engagement portion comprises an engagement groove.

The engagement groove may comprise a first lateral side wall, a second lateral side wall and a bottom wall. Preferably intersections between the lateral side walls and the bottom wall prevent rotation of a part of the D-ring engaged therein. The lateral side walls and the bottom wall may form an intersection of substantially 90 degrees (preferably less than or equal to 90 degrees and preferably greater than 70 or 80 or 85 degrees).

The side walls may be arranged to engage and/or abut respective (outer) side walls provided by a part of the D-ring.

Preferably the engagement groove is arranged to engage a brace member of the D-ring. Preferably the engagement groove is arranged to engage an intermediate brace member of the D-ring.

Preferably the engagement groove comprises an open face to enable insertion of the part of the D-ring into an engagement position within the engagement groove.

Preferably the engagement groove comprises a linear engagement groove.

Preferably the engagement groove extends along a full lateral length of the body from a first lateral end to a second lateral end.

Preferably the engagement portion entraps a part of the D-ring.

Preferably the engagement groove engages a part of the D-ring to orientate the coupler outwardly (and away) from the D-ring and preferably for the distal end of the body to locate outward from a part of the D-ring. Preferably the engagement groove engages a part of a D-ring to orientate the body substantially perpendicular to the D-ring with the distal end of the body preferably locating at a most distant extent relative to the D-ring.

Preferably the engagement groove secures the orientation of the body relative to the D-ring and prevents (inhibits) significant rotational/pivotal movement of the body about the part of the D-ring engaged within the engagement groove.

Preferably the webbing guidance surface comprises a curved surface. Preferably the angle of the curved surface passes through substantially 270-360 degrees.

Preferably the webbing guidance surface comprises an upper section, an intermediate section (transitional section) and a lower section. The upper section may be substantially parallel to the lower section.

The intermediate section may comprise a substantially hemi-cylindrical surface.

The webbing guidance surface is shaped to transmit a tensile force in the webbing straps to urge the coupler into engagement with a part of a D-ring.

The guidance surface has a first lateral side providing a first retaining wall and a second lateral side providing a second retaining wall, the first and second retaining walls arranged to retain the webbing within the guidance surface.

Preferably the webbing guidance surface comprises an external exposed (open) surface around the outermost distal end of the body.

Preferably the first retaining wall extends around the intermediate section of the webbing guidance surface. Preferably the first retaining wall provides a smooth surface to guide the webbing. Preferably the first retaining wall is curved as the first retaining wall extends from the upper section around the intermediate section and to the lower section. Preferably the first retaining wall is shaped (curved) inwardly as the first retaining wall extends from the upper section around the intermediate section and is shaped (curved) outwardly to the lower section.

Preferably the second retaining wall extends around the intermediate section of the webbing guidance surface. Preferably the second retaining wall provides a smooth surface to guide the webbing. Preferably the second retaining wall is curved as the second retaining wall extends from the upper section around the intermediate section and to the lower section. Preferably the second retaining wall is shaped (curved) inwardly as the first retaining wall extends from the upper section around the intermediate section and is shaped (curved) outwardly to the lower section.

Preferably the first retaining wall and the second retaining wall define a webbing guidance surface therebetween. Preferably a lateral extent of the webbing guidance surface varies between the upper section, intermediate section and the lower section. Preferably the lateral extent of the webbing guidance surface (gradually) decreases from the upper section to the intermediate section and then the lateral extent of the webbing guidance surface may (gradually) increase from the intermediate section to the lower section.

Preferably the intermediate section provides a narrow webbing guidance surface relative to the webbing guidance surface in the upper section and/or the lower section.

The securement passageway may provide a cylindrical passageway. Preferably the securement passageway provide a uniform internal bearing surface (with a uniform cross sectional profile) through the entire lateral width of the body.

Preferably the securement passageway defines a rotational axis about which a shaft contained therein is rotatable.

The internal surface of the securement passageway may provide a bearing surface for a plain bearing whereby a shaft of the connector acts as a journal and the securement passageway acts as the bearing surface. The body/securement passageway may comprise an integral plain bearing.

Preferably the passageway is a linear cylindrical passageway.

According to a second aspect of the present invention there is provided a fall protection assembly comprising a harness comprising webbing, a D-ring and a coupler for a fall protection device, wherein the coupler comprises a body having:

- a distal end and a proximal end;
  - the distal end comprising a webbing guidance surface over which the webbing extends; and
  - the proximal end comprising an engagement portion to engage the D-ring of the harness,
- the body further comprising a securement passageway through which a shaft of a connector of a fall protection device is securable, the securement passageway comprising a bearing surface which acts with an outer surface of the shaft of the connector to enable the shaft of the connector to rotate within the securement passageway and for the connector to articulate relative to the coupler.

The assembly may comprise a fall protection device. The fall protection device may comprise a connector for connecting the fall protection device to the coupler.

Preferably the assembly comprises a first fall protection device and a second fall protection device.

Preferably each fall protection device comprises a fastener for (independently) fastening the respective fall protection device to the connector. Preferably the or each fastener comprises a swivel eye. Preferably the or each swivel attaches/mounts the respective fall protection device to the connector. The connector may comprise a dual (or double/twin) connector.

Preferably the connector comprises a shaft. Preferably the shaft is arranged, in use, to extend through the securement passageway.

Preferably the shaft is arranged to rotate within the passageway. Preferably the shaft is arranged to rotate about a central longitudinal axis of the passageway.

Preferably the connector comprise a retaining section. The shaft may be movable between an open position in which the connector is open and a closed position in which the retaining section and the shaft form a contiguous connector (ring or loop).

The connector may comprise a lock mechanism to lock the shaft in the closed potion. The connector may comprise an urging device to urge the connector to the closed configuration.

The D-ring may comprises a brace member. The brace member may extend between two lateral side members of the D-ring. The D-ring may comprises a first brace member, a second brace member and an intermediate brace member located therebetween. Preferably each brace member extends between lateral side members of the D-ring. Preferably the engagement portion is arranged to engage the intermediate brace member.

The D-ring may comprises a D-ring pad. The D-ring pad may guide the webbing from the harness towards (and/or away from) the D-ring and/or the coupler.

The webbing may comprise a first webbing strap and a second webbing strap. The webbing straps extend down a rear (back) part of a torso of a user to provide a first/right shoulder/rear strap and a second/left shoulder/rear strap.

The guidance surface has a first lateral side providing a first retaining wall and a second lateral side providing a second retaining wall, the first and second retaining walls arranged to retain the webbing within the guidance surface.

According to a third aspect of the present invention there is provided a method of connecting a fall protection device to a harness comprising providing a coupler on the harness, wherein the coupler comprises a body having:

a distal end and a proximal end;

the distal end comprising a webbing guidance surface over which webbing is extendable; and the proximal end comprising an engagement portion to engage a D-ring of a harness, the method comprising securing a shaft of a connector of a fall protection device through a securement passageway provided by the body of the coupler and wherein the securement passageway comprising a bearing surface which acts with an outer surface of the shaft of the connector to enable the shaft of the connector to rotate within the securement passageway and for the connector to move relative to the coupler.

Preferably the method comprises connecting a first fall protection device to the harness and a second fall protection device to the harness.

Preferably the method comprises providing a dual (double/twin) fall protection system.

The guidance surface has a first lateral side providing a first retaining wall and a second lateral side providing a second retaining wall, the first and second retaining walls arranged to retain the webbing within the guidance surface.

BRIEF DESCRIPTION OF THE DRAWINGS

The present invention will now be described, by way of example embodiments, with reference to the drawings that follow, in which.

DESCRIPTION OF EMBODIMENTS

Embodiments of the present invention relate to a coupler 10 for use in the connection of a fall protection device to a harness. The term fall protection device is defined to include both fall restraint devices, fall arrest devices and similar apparatus such as rescue devices. For example, the fall protection device may comprise a self-retracting lanyard (SRL) or self-retracting lifeline or other system. As mentioned above, a fall protection device such as an SRL is arranged to stop and/or absorb some of the energy of a fall by providing a braking system which aims to provide a relatively gradual decrease in the falling speed of a person in order to arrest and stop the fall whilst also not causing injury to the user. Each embodiment of the present invention is of particular use with one or more, preferably two, fall protection devices in which such devices are used to protect a user.

Figure 1:
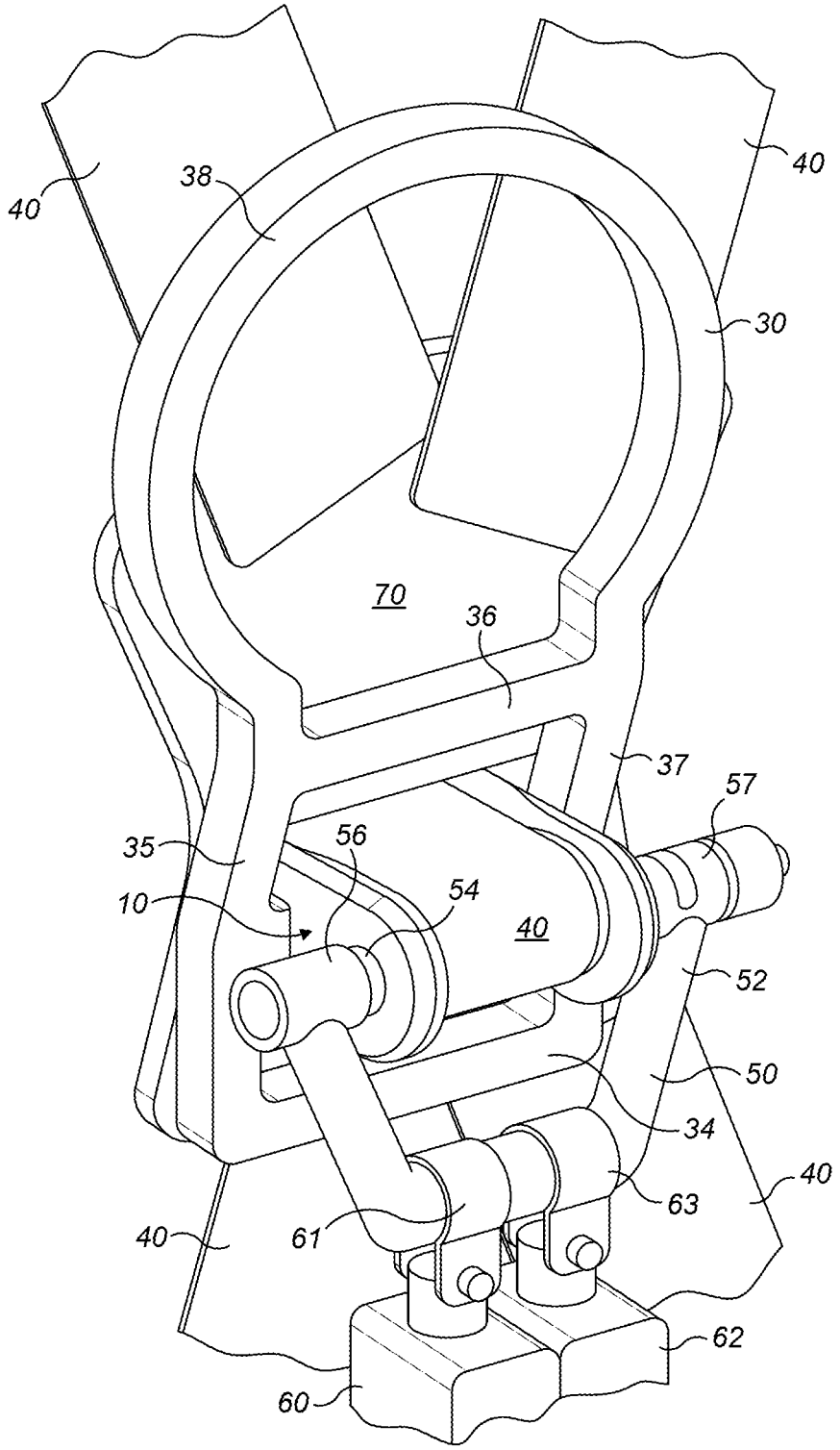
FIG. 1 is a view of a preferred embodiment of a coupler being used in the connection of a fall protection device to a harness.
Figure 2:
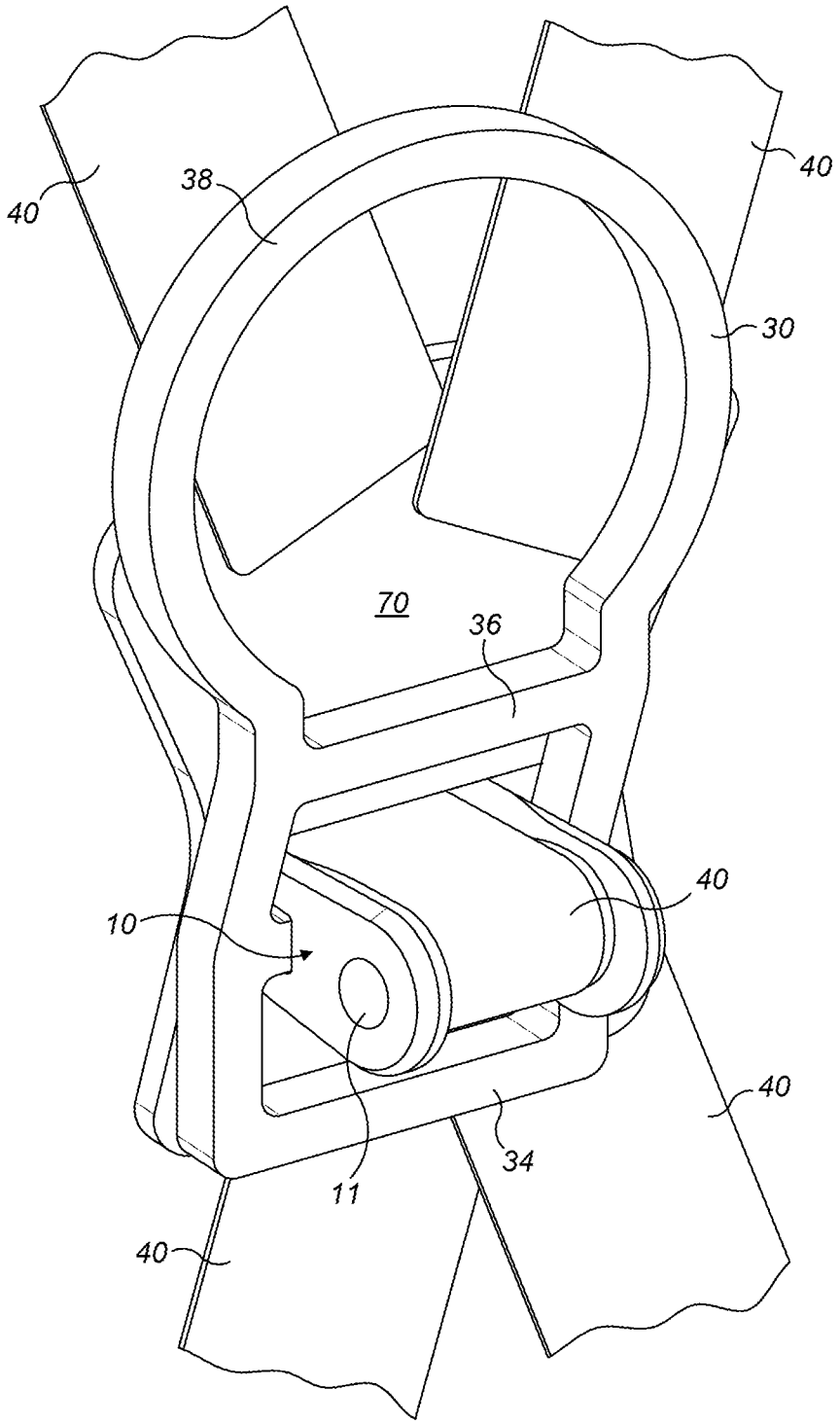
FIG. 2 is a perspective view of a preferred embodiment of a coupler engaged with a D-ring and webbing straps of a harness.
Figure 3:
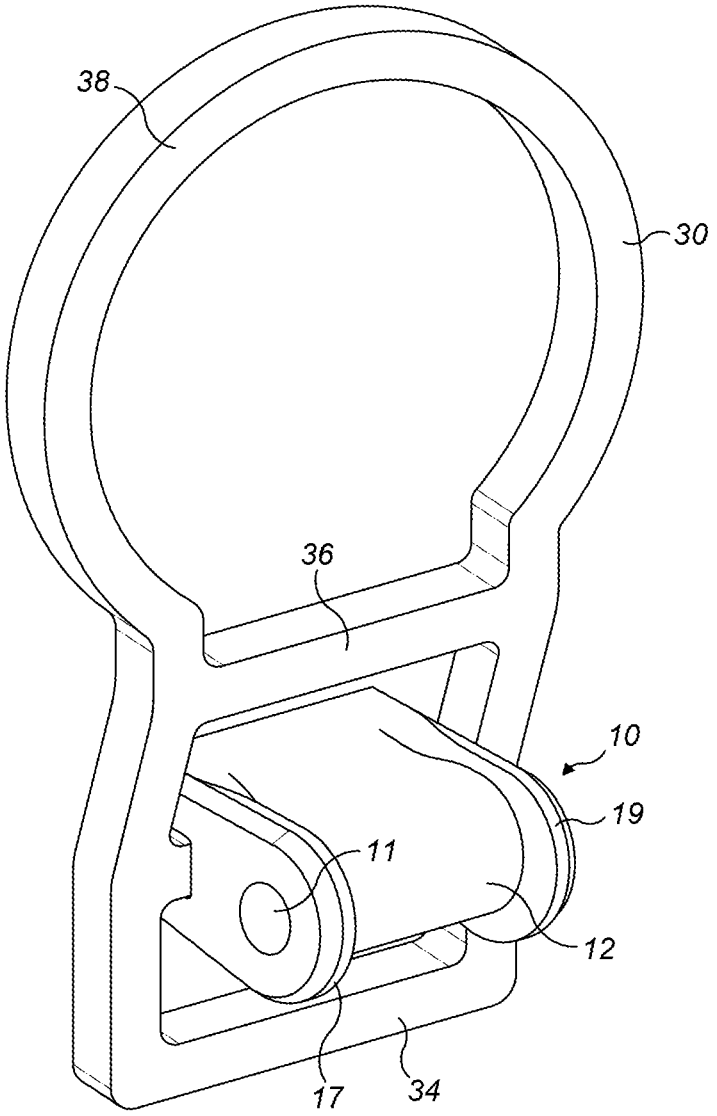
FIG. 3 is a perspective view of a preferred embodiment of a coupler and a D-ring of a harness.

As shown in FIG. 1, FIG. 2, FIG. 3 and FIG. 4, the coupler 10 is arranged to locate between the webbing straps 40 of a harness and a part of a D-ring 30 provided on the harness worn by a user. FIG. 1 shows the coupler 10 in an installed position with the webbing straps 40 extending over and around the coupler 10.

The coupler 10 provides a securement passageway 11 though which a part of a connector 50 can extend in order to secure the connector 50 to the harness. In particular, a shaft 54 of the connector 50 is arranged to extend through the passageway 11. The or each fall protection device 60, 62 includes a fastener or a securement component which may be in the form of a swivel eye 61, 63. The swivel eye(s) 61, 63 may be engaged on a retaining/closed section 52 of the connector 50 and the shaft 54 of the connector 50 is then inserted through the passageway 11 which thereby mounts the fall protection device(s) 60, 62 to the harness.

The connector 50 includes a shaft 54 which is arranged to extend through the securement passageway 11 of the coupler 10. The dimensions of the shaft 54 and the passageway 11 are arranged such that the connector 50 is free to pivot and rotate around the coupler 10. In particular, the longitudinal axis 27 of the passageway 11 defines and provides the rotational/pivotal axis 27 about which the connector 10 is free to pivot/rotate.

In use, the person wearing the harness may be continually moving and the orientation and angle of the fall protection device(s) 60, 62 and associated connector 50 will thereby be wanting to move relative to the person and the harness since the respective lifeline(s) will be tethered at the distal end. In a prior art arrangement, a shaft of the connector may be simply inserted underneath the webbing straps 40 and the D-ring 30 and this may allow movement of the connector 50 relative to the harness. This movement would not be restrained about a fixed rotational axis 27 and the connector 50 may also freely move laterally and/or up and down relative to the webbing straps 40 under which the connector shaft 54 is restrained. The continual movement (rotational, lateral and other translational movement) of the connector 50 against the webbing will gradually cause wear and tear of the webbing 40 and may therefore weaken the webbing 40. Accordingly, such a harness may become hazardous and dangerous due to this weakness being introduced through the use of the harness. Embodiments of the present invention prevent such wear and tear on the webbing since the connector 50 freely rotates within the passageway provided by the coupler. Any significant relative up/down forces are accommodated through pivoting/rotation. In addition, relative lateral movement is restrained by the capture of the webbing 40 by lateral guide walls 17, 19 and the shaft 54 may be a permitted to have a restricted amount of lateral movement through the passageway 11.

In addition, the coupler 10 allows the webbing straps 40 to be moved (lengthened/shortened) such as required through the adjustment of the harness as required by a user.

The coupler 10 can simply be inserted by pulling the webbing straps 40 away from the D-ring 30. The coupler 10 can then be inserted and the webbing straps 40 tightened/pulled back through the D-ring pad 70 to secure the coupler 10 in position. Such a simple and easy installation method enables the coupler 10 to be easily installed and/or replaced should this be needed, for example if damage is noted or if weakening is suspected.

An embodiment of the coupler 10 will now be described in more detail with reference to a system incorporating two fall protection devices 60, 62.

As shown in FIGS. 5 to 12, the coupler 10 comprises a single component. In particular, the coupler is a single moulded body and preferably comprises nylon. However, other suitable materials may be used.

The coupler 10 comprises a first surface or top/distal end 12 and a second surface or bottom/proximal end 14. The coupler has a first lateral end 16 and a second (opposite) lateral end 18.

The top/distal end 12 provides a shaped surface over which the webbing straps 40 are arranged to locate, in use. The shaped surface provides a smooth curved surface over which the webbing straps 40 can be safely retained.

The lateral ends 16, 18 of the coupler provide a respective guide/retaining wall 17, 19 to maintain the webbing straps 40 extending over the distal end 12 and the shaped surface of the coupler 10. The retaining walls 17, 19 prevent the lateral movement of the coupler 10 in to a position out of alignment with the webbing straps 40. Such a position may cause the webbing straps 40 to be worn away though movement whilst located at a position of the intersection between the shaft 54 and the retaining section 52 of the connector 50. Such an intersection may be angled and may readily cause excessive abrasion of the webbing 40 through repeated movement.

The proximal end 14 of the coupler 10 provides an engagement portion 14*a* to engage the D-ring 30 and to secure the coupler 10 relative to the D-ring 30. In the preferred embodiment, a groove 15 or channel is defined along the proximal end 14 into which a part of the D-ring 30 is arranged to be engaged. The groove 15 extends along the full width of the coupler 10. The groove 15 is arranged to engage with a reinforcement member or brace 32 of the D-ring 30. In particular, the groove is arranged to engage an intermediate brace 23 provided by the D-ring 30.

The D-ring provides a closed loop or ring 38 by which a single conventional fall protection device may be connected. However, such a ring 38 or loop could cause problems if two independent fall protection devices are to be secured to the harness. For this reason, connectors are commonly used for dual/double fall protection device systems and similar connectors may also be used for single fall protection device systems.

Figure 4:
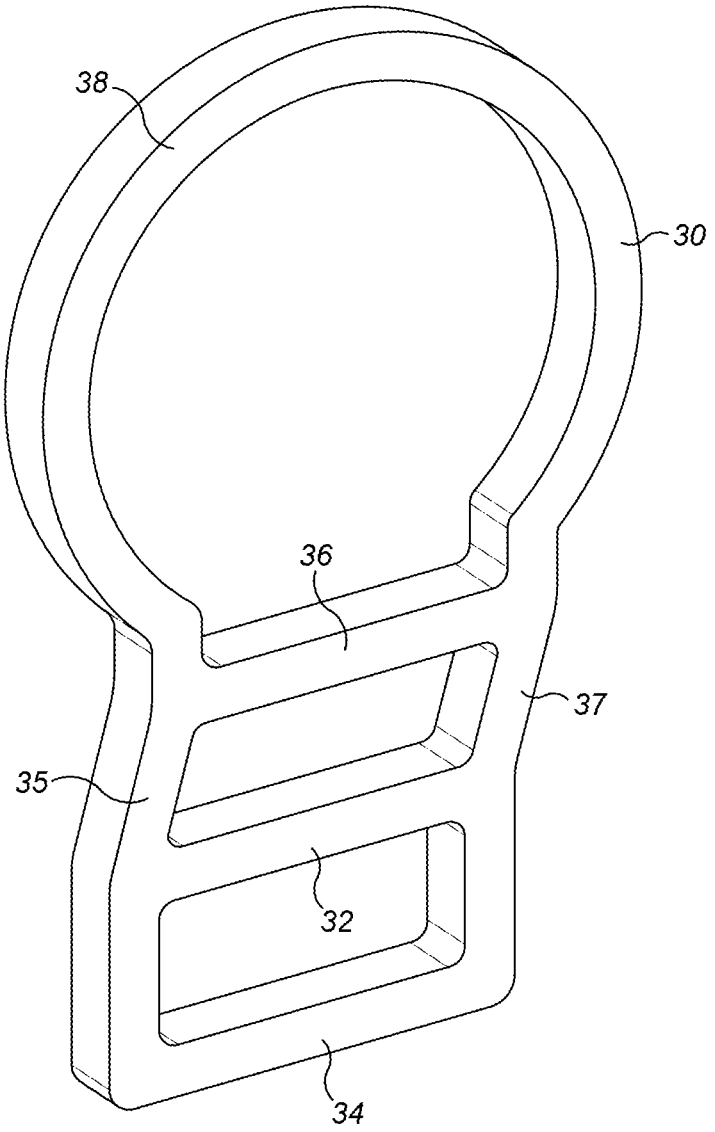
FIG. 4 is a perspective view of an embodiment of a D-ring.
Figure 5:
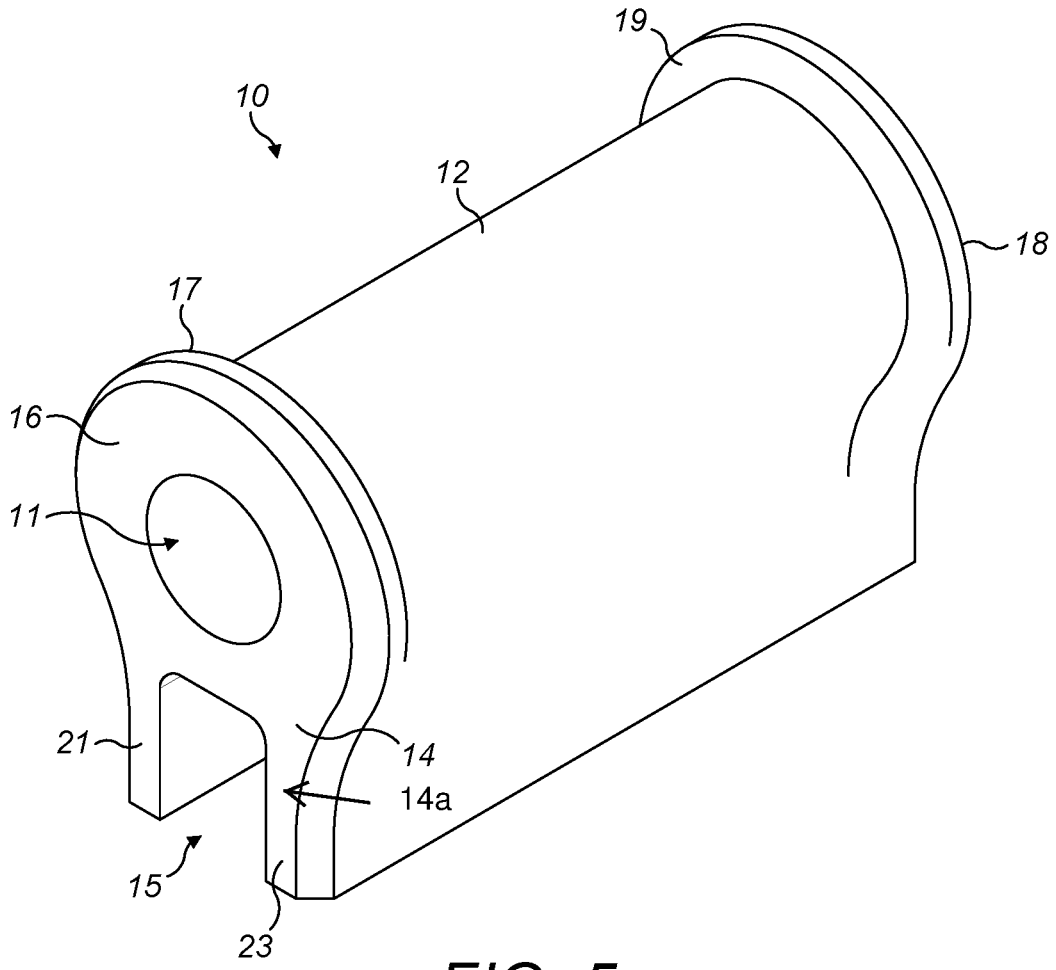
FIG. 5 is a perspective view of a preferred embodiment of a coupler.
Figure 6:
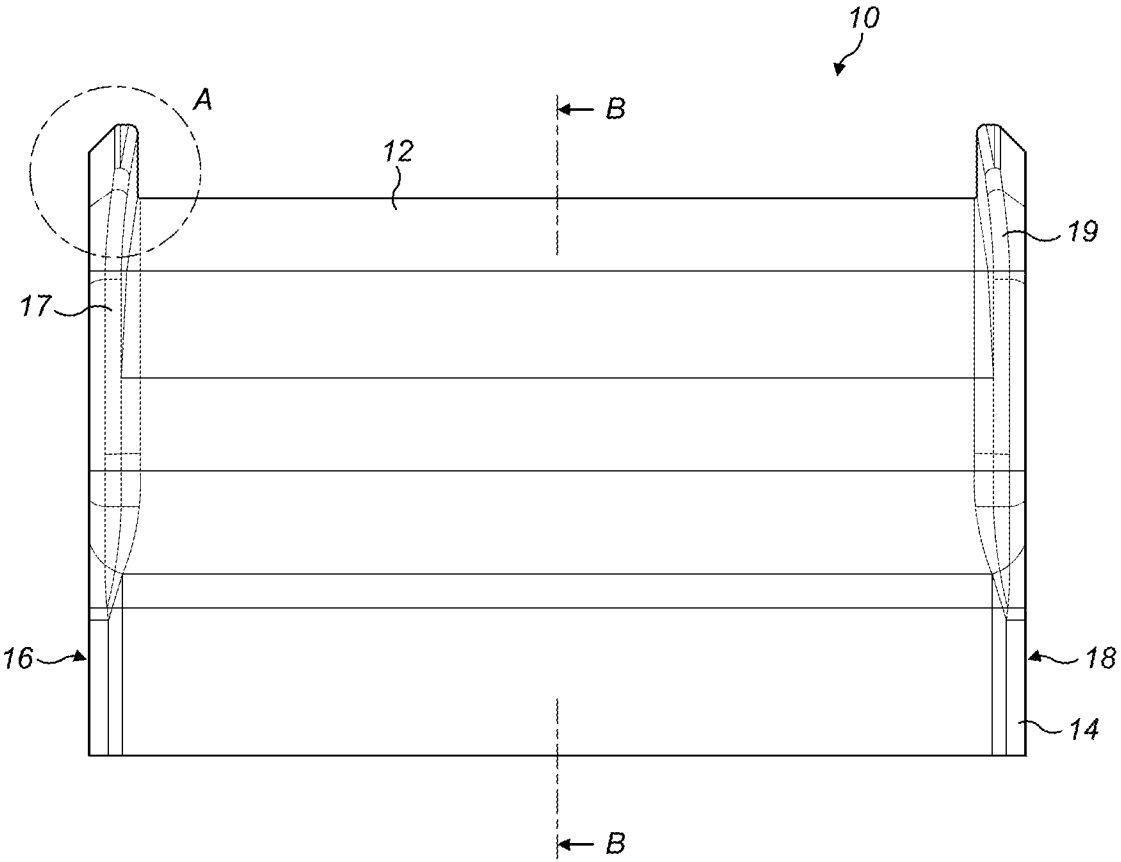
FIG. 6 is a front view of a preferred embodiment of a coupler.
Figure 7:
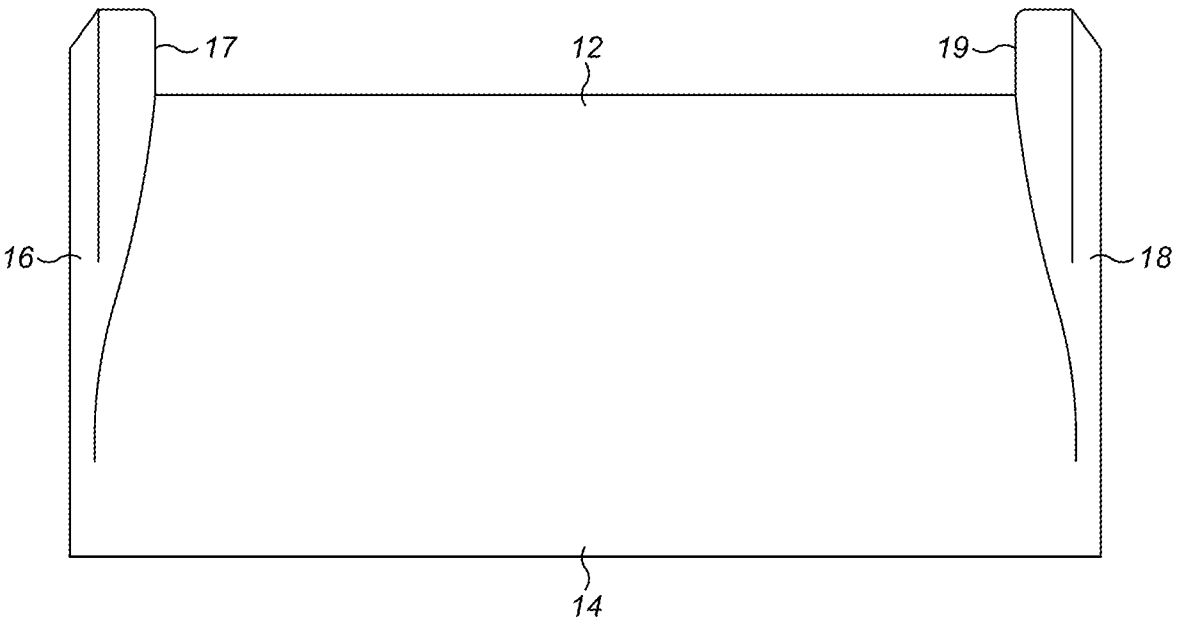
FIG. 7 is another front view of a preferred embodiment of a coupler.
Figure 8:
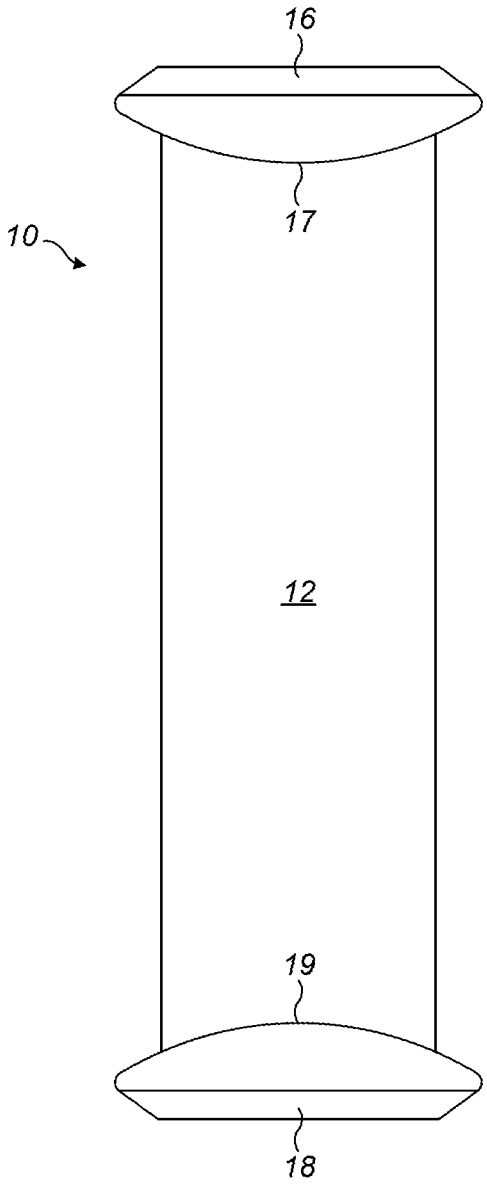
FIG. 8 is a top view of a preferred embodiment of a coupler.
Figure 9:
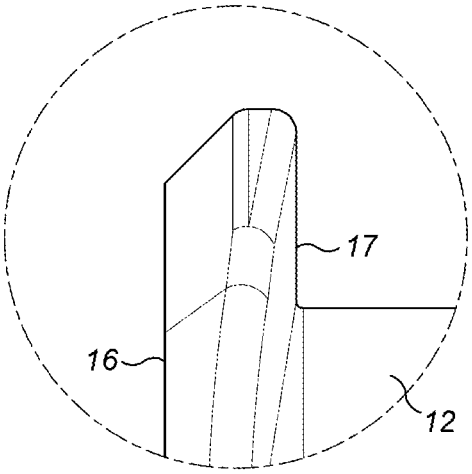
FIG. 9 is a detailed view of a front view of a preferred embodiment of a coupler as indicated by A in FIG. 6.

As shown in FIG. 4, the D-ring 30 includes a lower brace/reinforcement member 34, an upper brace/reinforcement member 36 and an intermediate brace/reinforcement member 32. The webbing 40 is arranged to be threaded and criss-crossed through the openings defined between the braces 32, 34, 36. The webbing 40 extends from behind the D-ring 30 and through the opening defined between the upper brace member 36 and the intermediate brace member 32. The webbing 40 then extends back through the opening defined between the intermediate brace member 32 and the lower brace member 34. The coupler 10 is designed to extend away from the intermediate brace member 32 and locates within a space created between the webbing 40 and the front of the D-ring 30, specifically the intermediate brace member 32.

In use, the natural/operational tension within the webbing straps 40 urges the coupler 10 towards the intermediate brace member 32. In particular, the force within the webbing straps 40 is transferred to the shaped surface around the distal end 12 of the coupler 10 which urges the coupler 10 into engagement with the intermediate brace member 32. The tension is maintained within the straps 40 to continually force the coupler into engagement with the D-ring 30. For example, the tension in the straps 40 may be confined by limiters which set the length of the straps and/or the arrangement and path of the straps 40 through the D-ring pad 70 and around the coupler 10.

The retaining groove 15 or channel provided on the proximal end of the coupler 10 allows the simple insertion of the intermediate brace member 32. The dimensions of the groove 51 may be defined to engage and accommodate the intermediate brace member 32 without any significant free movement. The groove 15 may therefore be bespoke to the particular D-ring 30 and dictated by the size and shape of a respective brace member of the D-ring 30.

Figure 10:
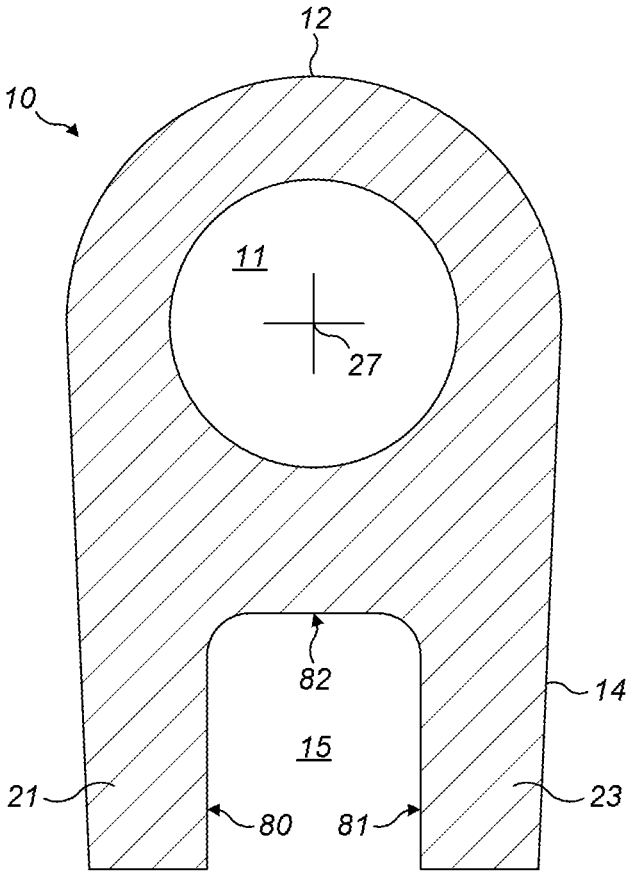
FIG. 10 is a cross section through B-B in FIG. 6 of a preferred embodiment of a coupler.
Figure 11:
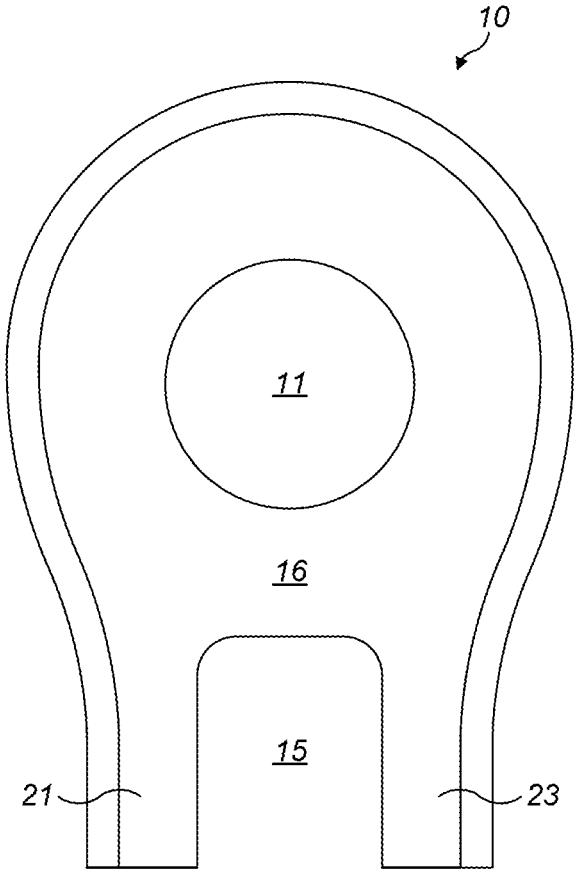
FIG. 11 is a side view of a preferred embodiment of a coupler.
Figure 12:
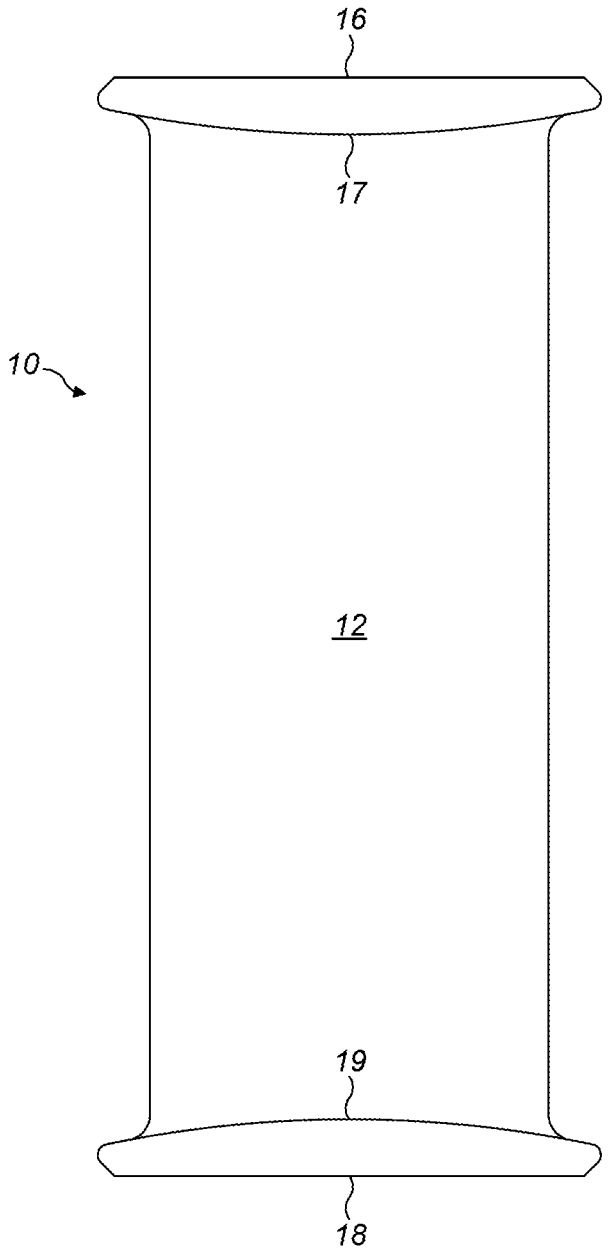
FIG. 12 is a top view of an embodiment of a coupler.

The groove 15 is defined by two side walls 80, 81 and a connecting bottom wall 82 (see FIG. 10). As explained above, the dimensions (and shape) of the groove 15 is designed to accommodate the respective brace member 32 of the D-ring.

The lateral width of the coupler 10 is arrange such that the coupler 10 can locate between two side members 35, 37 of the D-ring 30. In use, a part of the coupler 10 locates within the openings defined between the upper, intermediate and lower brace members 32, 34, 36 add the side members 35, 37 of the D-ring 30. The coupler provides a first elongate portion 21 and a second elongate portion 23 which locate in different openings either side of the intermediate brace member 32.

The outer end faces of the coupler 10 at each lateral end 16, 18 locate adjacent to opposing inner side surfaces of the side members 35, 37 of the D-ring 30. The interaction between the lateral ends 16, 18 and the side members 35, 37 restrain the lateral movement of the coupler 10 relative to the D-ring 30. This prevents any unnecessary relative movement of the fall protection system and helps the smooth movement of the user whilst attached to the fall arrest/protection device (and/or associated lifelines).

The coupler 10 provides a passageway 11 which extends from the first lateral end 16 to the second lateral end 18. A shaft 54 of the connector is arranged to extend through the passageway 11. The inner surface of the passageway 11 provides a bearing surface which surrounds the outer surface of the connector shaft 54. The longitudinal axis 27 of the passageway 11 thereby provides a rotational axis 27 about which the connector 10 is constrained to rotate/pivot without any excessive translational movement.

The rotational movement of the connector shaft 54 within the bearing surface of the passageway 11 thereby prevents direct abrasion of the webbing straps 40 which would otherwise occur.

The connector 50 and/or connector shaft 54 may have abutment surface or collars 56, 57 which restrict the amount of relative longitudinal/axial movement of the coupler along the shaft 54. Again, this further provides predictable restraint to the user without instigating sudden changes in the restraining forces of the fall protection devices as the user moves around. Additionally and importantly, this reduces any wear on the webbing straps 40 which may change the integrity of the fall protection system.

The dimensions of the shaft 54 may be selected so as to closely cooperate with the internal bearing surface of the passageway 11 so as to provide a (integral) plain bearing arrangement. In particular, the shaft 54 will act as the journal and rotate within the confines of the bearing surface provide by the internal cylindrical surface of the passageway 11. The passageway 11 may therefore be bespoke to the particular shaft 54/connector 50 and dictated by the size and shape of the respective shaft 54 (or vice versa). Specifically, the diameters of the passageway 11 and shaft 54 will be bespoke and matched.

Each fall protection device 60, 62 has a fastener in the form of a swivel eye 61, 63 (see FIG. 1). These swivel eyes 61, 63 provide closed loops or rings and enable the respective fall protection device 60, 62 to rotate and these fasteners reduce the resistance to movement as the user moves around. The swivel eyes 61, 63 are mounted on the closed side 52 of the connector 50 which is opposite the shaft 54. The shaft 54 thereby acts as a gate within the connector 50 whilst the closed side provides a retaining section 52. The retaining section 52 and the shaft 54 thereby form a contiguous loop or contiguous ring in the connected configuration and are configurable to provide an open loop/ring to enable the swivel eyes 61, 63 to be mounted on the connector 50. Therefore, the fall protection device 60, 62 rotates about the connector 50 and swivels about the swivel eyes 61, 63 to move in two different directions.

The shaft 54 is movable from an open position to a closed position and may be movable translationally along a longitudinal/axial direction. In the open position, an exposed/distal end of the shaft 54 can be inserted into the passageway 11 and the elongate shaft portion can be subsequently moved into the passageway 11 until the exposed/distal end of the shaft 54 engages with a securement device which enables the connector 50 to be locked in a closed position. The securement device may comprise a typical carabiner style connector in which the release mechanism may require a user to rotate a collar around the axis to enable the shaft to be withdrawn to an open position. The mechanism may have urging means such as a biasing member or a spring arrangement to force the shaft to a normally closed and locked position to prevent the connector 50 being inadvertently left in an unsafe configuration.

In the closed position the webbing straps are positioned within the aperture/opening of the connector 50 albeit the webbing straps are protected by the coupler 10. Accordingly, the coupler 10 facilitates the movement of the fall protection device relative to the webbing straps 40 (and user/harness) which prevents wear and tear/abrasion or other potential damage to the webbing straps 40.

In the event of a fall, even if the coupler 10 was to fracture or even catastrophically fail, then the webbing straps would still be retained within the connector 50.

In summary, embodiments of the present invention provide a connecting device (e.g., coupler 10) to couple a D-ring 30 from a harness to a dual fall arrest device connector 50 (which connects to one or more fall arrest blocks). The coupler 10 is preferably constructed from a single moulded piece of material (for example, nylon). The coupler 10 provides (inner) lips or walls 17, 19 which are curved with a variable fillet which guides and contains the webbing 40 whilst allowing it to move freely (reducing webbing wear) and does not necessitate the removal of either the device (coupler 10), connector 50 or D-ring 30 (as may be required for harness size adjustment). The coupler 10 has a single circular passageway 11 which runs through the length allowing the shaft 54 of a connector 50 to couple to the part whilst maintaining 180 degrees of swivel. The coupler 10 also has a groove 15 which runs along the length to fit onto the central bar 32 of a harness D-ring 30. The design is such that during a fall, should the device break the webbing 40 will remain securely coupled to the D-ring 30 of the harness.

The invention claimed is:

1. A coupler assembly for a fall protection device, comprising:

a D-ring;

a connector having a shaft;

a body having a distal end and a proximal end;

the distal end comprising a webbing guidance surface configured and arranged to support webbing; and the proximal end comprising an engagement portion configured and arranged to directly engage the D-ring, the engagement portion comprising first and second elongated portions forming a groove therebetween, the groove configured to receive a portion of the D-ring;

the body further comprising a securement passageway positioned between the webbing guidance surface and the engagement portion configured and arranged to receive the shaft of the connector, the securement passageway comprising a bearing surface configured and arranged to enable the shaft of the connector to rotate within the securement passageway and to enable the connector to articulate relative to the body;

the D-ring engaging the proximal end of the body and the shaft routed through the securement passageway when assembled, such that the body is configured to route webbing from the proximal end of the body to and around the webbing guidance surface of the distal end of the body, the body configured to be retained by the webbing, the D-ring, and the shaft when assembled, such that when the webbing is installed the webbing biases the body toward the D-ring and the webbing is routed around the body and the shaft, such that if the body breaks the webbing remains routed around the shaft and remains operatively connected to the D-ring.

2. A coupler assembly for a fall protection device according to claim 1 in which the body comprises a single piece component and a shape of the body is moulded to provide all individual elements of the body and the body is absent of any moving components.

3. A coupler assembly for a fall protection device according to claim 1 in which the groove comprises a first lateral side wall, a second lateral side wall and a bottom wall and intersections between the lateral side walls and the bottom wall prevent rotation of the part of the D-ring engaged therein.

4. A coupler assembly for a fall protection device according to claim 1 in which the groove is configured and arranged to prevent rotation of the D-ring.

5. A coupler assembly for a fall protection device according to claim 1 in which the groove comprises a linear engagement groove.

6. A coupler assembly for a fall protection device according to claim 1 in which the groove extends along a full lateral length of the body from a first lateral end to a second lateral end.

7. A coupler assembly for a fall protection device according to claim 1 in which the groove is configured to receive the part of the D-ring to orientate the body outwardly and away from the D-ring and for the distal end of the body to locate outward from the part of the D-ring.

8. A coupler assembly for a fall protection device according to claim 1 in which the groove is configured to secure the orientation of the body relative to the D-ring and prevents significant rotational movement of the body about the part of the D-ring engaged within the groove.

9. A coupler assembly for a fall protection device according to claim 1 in which the webbing guidance surface comprises a curved surface and the webbing guidance surface comprises an upper section, an intermediate section and a lower section and wherein the upper section is substantially parallel to the lower section and the intermediate section comprises a substantially hemi-cylindrical surface.

10. A coupler assembly for a fall protection device according to claim 1 in which the guidance surface has a first lateral side providing a first retaining wall and a second lateral side providing a second retaining wall, wherein the first and second retaining walls are arranged to retain the webbing within the guidance surface.

11. A coupler assembly for a fall protection device according to claim 10 in which the first and second retaining walls extend outwardly from the first and second lateral sides of an intermediate section of the webbing guidance surface and the first and second retaining walls are configured to prevent lateral movement of the webbing relative to the guidance surface and wherein the first and second retaining walls are shaped inwardly as the first and second retaining walls extend from the upper section around the intermediate section and the first and second retaining walls are shaped outwardly as the first and second retaining walls extend from the intermediate section to the lower section.

12. A coupler assembly for a fall protection device according to claim 10 in which the first retaining wall and the second retaining wall define the webbing guidance surface therebetween and a lateral extent of the webbing guidance surface varies between an upper section, intermediate section and a lower section and wherein the lateral extent of the webbing guidance surface gradually decreases from the upper section to the intermediate section and then the lateral extent of the webbing guidance surface gradually increases from the intermediate section to the lower section.

13. A coupler assembly for a fall protection device according to claim 12 in which the intermediate section provides a narrow webbing guidance surface relative to the webbing guidance surface in the upper section and/or the lower section.

14. A coupler assembly for a fall protection device according to claim 1 in which the securement passageway provides a cylindrical passageway and the securement passageway provides a uniform internal bearing surface through the entire lateral width of the body and wherein the securement passageway defines a rotational axis about which a shaft contained therein is rotatable.

15. A coupler assembly for a fall protection device, comprising:

a D-ring;

a connector having a shaft;

a body having a distal end and a proximal end;

the distal end comprising a webbing guidance surface configured and arranged to support webbing; and the proximal end comprising an engagement portion configured and arranged to engage the D-ring, the engagement portion comprising first and second elongated portions forming a groove therebetween, the groove configured to receive a portion of the D-ring;

the body comprising a single piece component and being absent of any moving components;

the body further comprising a securement passageway configured and arranged to receive the shaft of the connector, the securement passageway comprising a bearing surface configured and arranged to enable the shaft of the connector to rotate within the securement passageway and to enable the connector to articulate relative to the body;

the D-ring engaging the proximal end of the body and the shaft routed through the securement passageway when assembled, such that the body is configured to route webbing from the proximal end of the body to and around the webbing guidance surface of the distal end of the body, the body configured to be retained by the webbing, the D-ring, and the shaft when assembled, such that when the webbing is installed the webbing biases the body toward the D-ring and the webbing is routed around the body and the shaft, such that if the body breaks the webbing remains routed around the shaft and remains operatively connected to the D-ring.

16. A coupler assembly for a fall protection device according to claim 15 in which the groove comprises a first lateral side wall, a second lateral side wall, and a bottom wall and intersections between the lateral side walls and the bottom wall prevent rotation of the part of the D-ring engaged therein.

17. A coupler assembly for a fall protection device according to claim 16 in which the groove extends along a full lateral length of the body from a first lateral end to a second lateral end.

18. A coupler assembly for a fall protection device according to claim 16 in which the groove is configured to secure the orientation of the body relative to the D-ring and prevents significant rotational movement of the body about the part of the D-ring engaged within the groove.

19. A coupler assembly for a fall protection device according to claim 15 in which the webbing guidance surface comprises a curved surface and the webbing guidance surface comprises an upper section, an intermediate section, and a lower section, and wherein the upper section is substantially parallel to the lower section and the intermediate section comprises a substantially hemi-cylindrical surface.

20. A coupler assembly for a fall protection device according to claim 15 in which the guidance surface has a first lateral side providing a first retaining wall and a second lateral side providing a second retaining wall, wherein the first and second retaining walls are arranged to retain the webbing within the guidance surface.

21. A coupler assembly for a fall protection device according to claim 20 in which the first and second retaining walls extend around an intermediate section of the webbing guidance surface and the first and second retaining walls provide a smooth surfaces to guide the webbing and wherein the first and second retaining walls are shaped inwardly as the first and second retaining walls extend from an upper section around the intermediate section and the first and second retaining walls are shaped outwardly as the first and second retaining walls extend from the intermediate section to a lower section.

22. A coupler assembly for a fall protection device according to claim 20 in which the first retaining wall and the second retaining wall define the webbing guidance surface therebetween and a lateral extent of the webbing guidance surface varies between an upper section, intermediate section and a lower section and wherein the lateral extent of the webbing guidance surface gradually decreases from the upper section to the intermediate section and then the lateral extent of the webbing guidance surface gradually increases from the intermediate section to the lower section.

23. A coupler assembly for a fall protection device according to claim 22 in which the intermediate section provides a narrow webbing guidance surface relative to the webbing guidance surface in the upper section and/or the lower section.

24. A coupler assembly for a fall protection device, comprising:

a D-ring;

a connector having a shaft;

a body having a webbing end and a D-ring end;

the webbing end comprising a webbing guidance surface configured and arranged to support webbing; and the D-ring end comprising an engagement portion configured and arranged to directly engage the D-ring, the engagement portion comprising first and second elongated portions forming a groove therebetween, the groove configured to receive a portion of the D-ring;

the webbing end of the body further comprising a securement passageway positioned between the webbing guidance surface and the engagement portion configured and arranged to receive the shaft of the connector, the securement passageway comprising a bearing surface configured and arranged to enable the shaft of the connector to rotate within the securement passageway and to enable the connector to articulate relative to the body, the D-ring engaging the D-ring end of the body and the shaft routed through the securement passageway when assembled, such that the body is configured to route webbing from the D-ring end of the body to and around the webbing guidance surface of the webbing end of the body, the body configured to be retained by the webbing, the D-ring, and the shaft when assembled, such that when the webbing is installed the webbing biases the body toward the D-ring and the webbing is routed around the body and the shaft, such that if the body breaks the webbing remains routed around the shaft and remains operatively connected to the D-ring.

25. The coupler assembly for a fall protection device of claim 24, further comprising a fall arrestor coupled to the connector, the fall arrestor operable to slow the rate of fall of a fall protection device user.

* * * * *